US010655393B2

(12) United States Patent
Bryson

(10) Patent No.: US 10,655,393 B2
(45) Date of Patent: May 19, 2020

(54) ROTARY STEERABLE SYSTEM

(71) Applicant: Halliburton Energy Services, Inc., Houston, TX (US)

(72) Inventor: Alan Campbell Bryson, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 212 days.

(21) Appl. No.: 15/509,366

(22) PCT Filed: Oct. 17, 2014

(86) PCT No.: PCT/US2014/061118
§ 371 (c)(1),
(2) Date: Mar. 7, 2017

(87) PCT Pub. No.: WO2016/060683
PCT Pub. Date: Apr. 21, 2016

(65) Prior Publication Data
US 2017/0275948 A1 Sep. 28, 2017

(51) Int. Cl.
*E21B 7/06* (2006.01)
*E21B 17/20* (2006.01)
*E21B 4/02* (2006.01)

(52) U.S. Cl.
CPC ..... *E21B 7/062* (2013.01); *E21B 7/06* (2013.01); *E21B 7/067* (2013.01); *E21B 17/20* (2013.01); *E21B 4/02* (2013.01)

(58) Field of Classification Search
CPC . E21B 7/06; E21B 7/062; E21B 7/067; E21B 17/20; E21B 4/02
See application file for complete search history.

(56) References Cited

U.S. PATENT DOCUMENTS 6,116,354 A 9/2000 Buytaert
8,453,765 B2 * 6/2013 Haughom ..... E21B 17/1014 175/73
2002/0175003 A1 11/2002 Pisoni et al.
2004/0104051 A1 6/2004 Moriarty et al.
2005/0109542 A1 * 5/2005 Downton ..... E21B 7/062 175/73
2005/0247489 A1 11/2005 Jamieson
(Continued)

FOREIGN PATENT DOCUMENTS

WO 2014/098842 A1 6/2014

OTHER PUBLICATIONS

International Preliminary Report on Patentability issued in related Application No. PCT/US2014/061118 dated Apr. 27, 2017 (15 pages).
(Continued)

*Primary Examiner* — Yong-Suk Ro
(74) *Attorney, Agent, or Firm* — Alan Bryson; Baker Botts L.L.P.

(57) ABSTRACT

An example apparatus for controlling the direction of drilling a borehole includes a housing and a radially offsetable drive shaft at least partially within the housing. The apparatus may further include one or more pusher extendable from the housing. The one or more pusher may be extendable in response to a radial offset in the offsetable drive shaft with respect to a longitudinal axis of the housing.

11 Claims, 3 Drawing Sheets

(56) References Cited

U.S. PATENT DOCUMENTS

Figure 1:
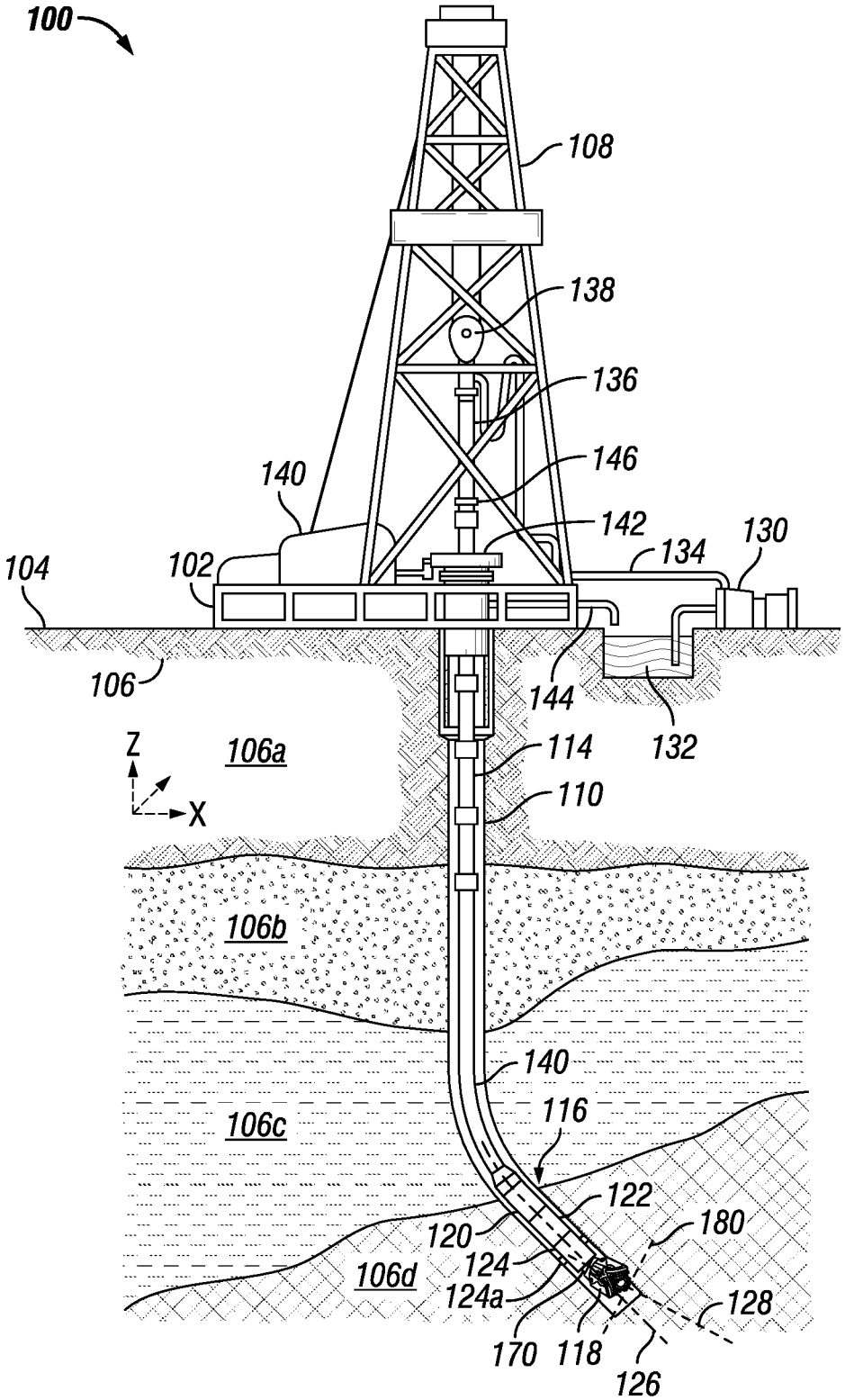

| | | | | |
|---|---|---|---|---|
| 2009/0308659 | A1* | 12/2009 | Crowley | E21B 7/062 175/61 |
| 2011/0042144 | A1* | 2/2011 | Downton | E21B 7/067 175/73 |
| 2012/0160565 | A1 | 6/2012 | Downton et al. | |
| 2013/0043076 | A1 | 2/2013 | Larronde et al. | |
| 2013/0112483 | A1 | 5/2013 | Kibsgaard et al. | |
| 2013/0341095 | A1 | 12/2013 | Perrin et al. | |
| 2013/0341098 | A1 | 12/2013 | Perrin et al. | |
| 2014/0190750 | A1* | 7/2014 | Samuel | E21B 7/062 175/61 |
| 2014/0345944 | A1* | 11/2014 | Liu | E21B 17/028 175/40 |

OTHER PUBLICATIONS

International Search Report and Written Opinion issued in related PCT Application No. PCT/US2014/061118 dated Jun. 30, 2015, 16 pages.

* cited by examiner

ROTARY STEERABLE SYSTEM

CROSS-REFERENCE TO RELATED APPLICATION

The present application is a U.S. National Stage Application of International Application No. PCT/US2014/061118 filed Oct. 17, 2014, which is incorporated herein by reference in its entirety for all purposes.

BACKGROUND

The present disclosure relates generally to well drilling operations and, more particularly, to rotary steerable systems.

Hydrocarbons, such as oil and gas, are commonly obtained from subterranean formations that may be located onshore or offshore. The development of subterranean operations and the processes involved in removing hydrocarbons from a subterranean formation may be complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

Drilling a wellbore may include introducing a drill bit into the formation and rotating the drill bit with a drill string. In certain operations, a steering system may be used to precisely locate the drill bit—both vertically and horizontally—in the formation. An example steering system is a rotary steerable system (RSS), which may perform the steering functions while the drill string and drill bit are rotating by altering the axis of the drill bit with respect to the wellbore. A point-the-bit system generally refers to an RSS in which an axis of the drill bit is altered with respect to the axis of the RSS. A push-the-bit system generally refers to an RSS in which hydraulic or other fluid-controlled pistons extend from the RSS and contact the wall of the borehole.

Both common RSS types may have design challenges related, for example, to maximizing reliability and minimizing maintenance, due to the complex mechanical/electrical/hydraulic elements used in their implementation. The pistons of the push-the-bit system, for example, include multiple seals that wear down over time as they are exposed to harsh downhole conditions. Once the seals fail, the RSS must be removed to the surface for repair, which factors into the overall expense of the drilling operation.

FIGURES

Some specific exemplary embodiments of the disclosure may be understood by referring, in part, to the following description and the accompanying drawings.

FIG. 1 is a diagram illustrating an example drilling system, according to aspects of the present disclosure.

Figure 2A:
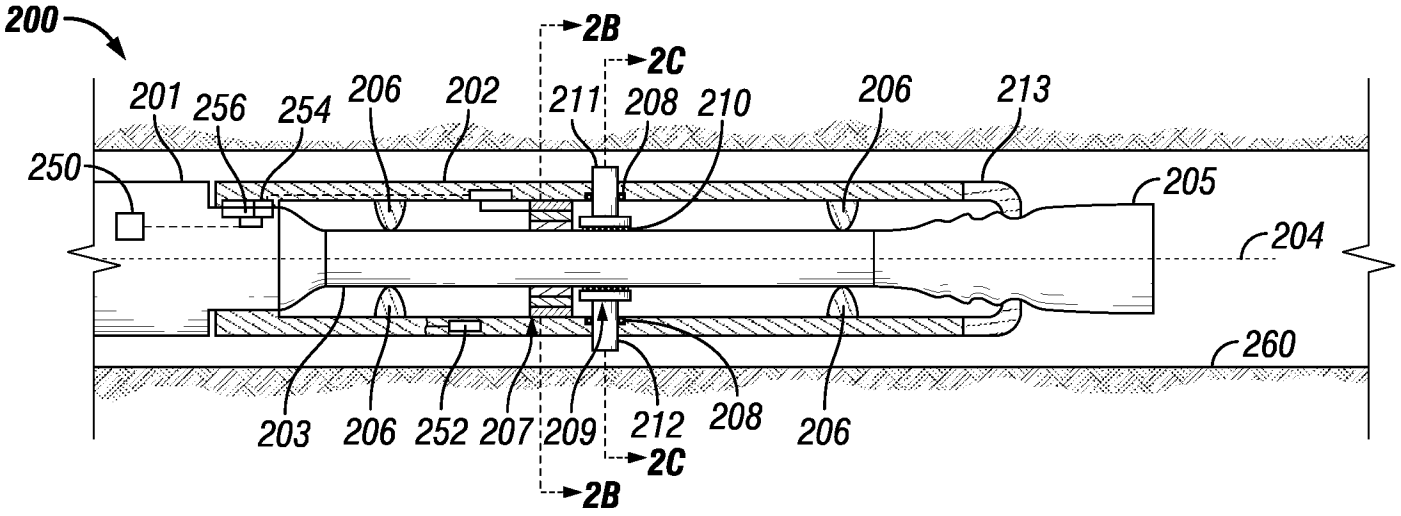
Figure 2C:
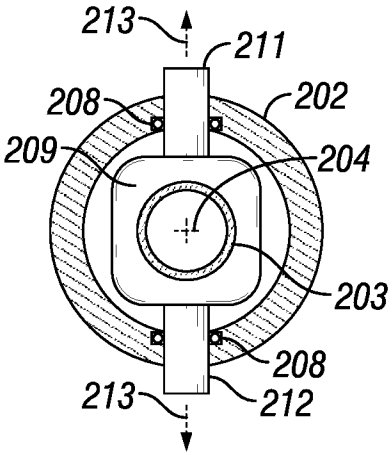
Figure 2B:
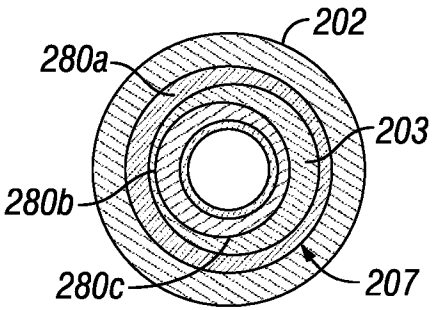

FIGS. 2A-C are diagrams illustrating an example steering assembly, according to aspects of the present disclosure.

Figure 3:
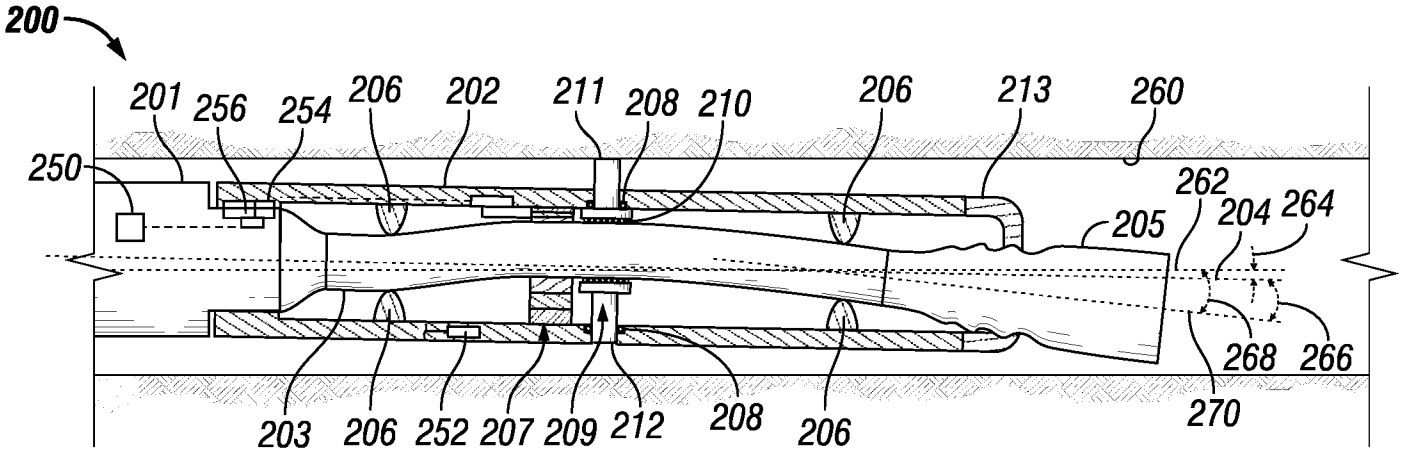

FIGS. 3 is a diagram illustrating another orientation of the example steering assembly in FIGS. 2A-C, according to aspects of the present disclosure.

Figure 4B:
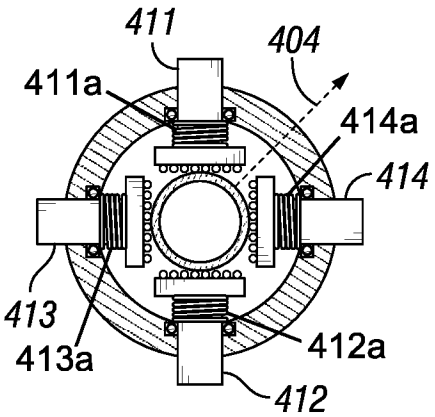
Figure 4A:
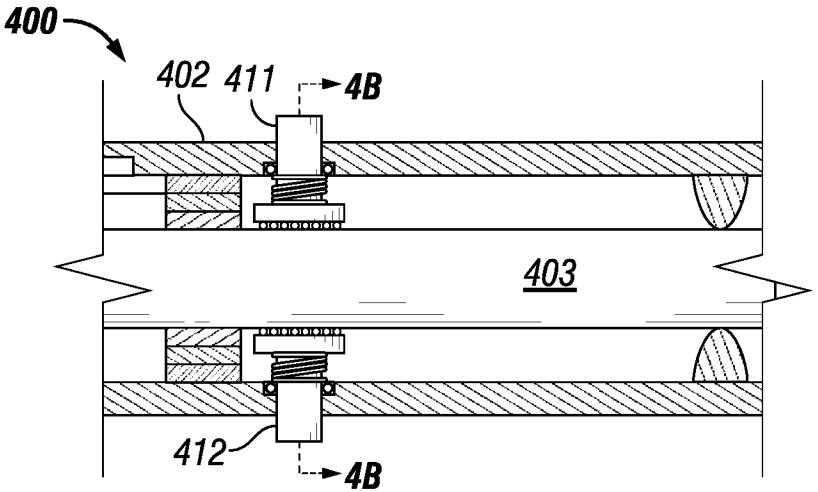

FIGS. 4A-B are diagrams illustrating another example steering assembly, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The disclosed embodiments are provided by way of example only, and are not exhaustive of the scope of the disclosure.

DETAILED DESCRIPTION

The present application teaches, in part, an RSS that combines aspects of both point-the-bit and push-the-bit RSS systems. In certain embodiments, a pusher, or a plurality of pushers, are circumferentially arranged along an RSS housing, and are radially movable to engage a borehole wall. Depending on the particular configuration, the pushers may be individually and/or synchronously extendable from the housing in response to a radial offset of a drive shaft. The radial offset may be achieved by radial deflection of a flexible drive shaft, for example. The radial engagement of the pushers with the borehole wall may impart a push-the-bit type steering response. The offset (e.g. deflection) of the shaft may simultaneously impart a point-the-bit type steering response.

The shaft deflection may be controlled, in some embodiments, by an eccentric ring assembly having a pair of eccentric rings controlled, electronically or otherwise, to control shaft deflection and the corresponding radial offset of the pusher(s). The radial offset of the shaft may be controlled in terms of magnitude and/or direction. For example, using an eccentric ring assembly, the relative position of the two rings may be controlled to affect a desired magnitude of shaft deflection, and the rotational position of the concentric ring assembly may be controlled to effect a desired direction of the shaft deflection. As the shaft is deflected, it may correspondingly urge one or more pushers in a radial direction, which is generally toward a borehole wall in use. The manner in which the deflection is controlled may be affected, as further described below, in terms of factors such as the number of pushers circumferentially located about the housing, and the particular manner in which the offset of the shaft interacts with the pushers to control radial displacement of the pushers. These and other example embodiments and example features are discussed further below.

Combining aspects of point-the-bit and push-the bit system may have numerous benefits including, for example, increasing the dog-leg capability of the RSS and decreasing the mechanical stresses on individual components of the RSS. Additionally, an RSS according to the teachings of the present disclosure may avoid the use of wear-prone pistons to control movement of the pushers. A resulting "pistonless" pusher configuration may thereby increase the reliability of RSS systems.

In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like.

Certain systems and methods are discussed below in the context of petroleum drilling and production operations in which information is acquired relating to parameters and conditions downhole. Several methods exist for downhole information collection, including logging-while-drilling ("LWD") and measurement-while-drilling ("MWD"). In LWD, data is typically collected during the drilling process, thereby avoiding any need to remove the drilling assembly to insert a wireline logging tool. LWD consequently allows the driller to make accurate real-time modifications or corrections to optimize performance while minimizing down time. MWD is the term for measuring conditions downhole concerning the movement and location of the drilling assembly while the drilling continues. LWD concentrates more on formation parameter measurement. While distinctions between MWD and LWD may exist, the terms MWD and LWD often are used interchangeably. For the purposes of this disclosure, the term LWD will be used with the understanding that this term encompasses both the collection of formation parameters and the collection of information relating to the movement and position of the drilling assembly.

The terms "couple" or "couples" as used herein may involve either a direct or indirect connection. For example, two mechanically coupled devices may be directly mechanically coupled when the mechanical coupling involves close or direct physical contact between the two devices, or indirectly mechanically coupled when the two devices are each coupled to an intermediate component or structure. The term "communicatively coupled" as used herein generally refers to an electronic (or, in some cases, fluid) connection via which two elements may electronically (or fluidically) communicate. An electronic coupling typically enables electrical power and/or data flow between elements. Such an electronic connection may involve a wired and/or wireless connection, for example, using Wifi, Bluetooth, or other wireless protocol, LAN, co-axial wiring, fiber-optic wiring, hard-wired physical connections, circuit board traces, or any other electronic signal medium or combinations thereof. As with direct and indirect physical connections, a first device may be directly communicatively coupled to a second device, such as through a direct electronic connection, or indirectly communicatively coupled, via intermediate devices and/or connections.

FIG. 1 is a diagram of a subterranean drilling system 100 including an example RSS 124 with a pistonless pusher, according to aspects of the present disclosure. The drilling system 100 comprises a drilling platform 102 positioned at the surface 104. In the embodiment shown, the surface 104 comprises the top of a formation 106 containing one or more rock strata or layers 106*a-d*, and the drilling platform 102 may be in contact with the surface 104. In other embodiments, such as in an off-shore drilling operation, the surface 104 may be separated from the drilling platform 102 by a volume of water.

The drilling system 100 comprises a derrick 108 supported by the drilling platform 102 and having a traveling block 138 for raising and lowering a drill string 114. A kelly 136 may support the drill string 114 as it is lowered through a rotary table 142 into a borehole 110. A pump 130 may circulate drilling fluid through a feed pipe 134 to kelly 136, downhole through the interior of drill string 114, through orifices in a drill bit 118, back to the surface via an annulus 140 formed by the drill string 114 and the wall of the borehole 110. Once at the surface, the drilling fluid may exit the annulus 140 through a pipe 144 and into a retention pit 132. The drilling fluid transports cuttings from the borehole 110 into the pit 132 and aids in maintaining integrity or the borehole 110.

The drilling system 100 may comprise a bottom hole assembly (BHA) 116 coupled to the drill string 114 near the drill bit 118. The BHA 116 may comprise a LWD/MWD tool 122 and a telemetry element 120. The LWD/MWD tool 122 may include receivers and/or transmitters (e.g., antennas capable of receiving and/or transmitting one or more electromagnetic signals). As the borehole 110 is extended by drilling through the formations 106, the LWD/MWD tool 122 may collect measurements relating to various formation properties as well as the tool orientation and position and various other drilling conditions. The telemetry sub 120 may transfer measurements from the LWD/MWD tool 122 to a surface receiver 146 and/or receive commands from the surface receiver 146. The telemetry sub 120 may transmit measurements or data through one or more wired or wireless communications channels (e.g., wired pipe or electromagnetic propagation). Alternatively, the telemetry sub 120 may transmit data as a series of pressure pulses or modulations within a flow of drilling fluid (e.g., mud-pulse or mud-siren telemetry), or as a series of acoustic pulses that propagate to the surface through a medium, such as the drill string 114.

The drill bit 118 may be driven by a downhole motor (not shown) and/or rotation of the drill string 114 to drill the borehole 110 in the formation 106. In certain embodiments, the downhole motor (not shown) may be incorporated into the BHA 116 directly above the drill bit 118 and may rotate the drill bit 118 using power provided by the flow of drilling fluid through the drill string 114. In embodiments where the drill bit 118 is driven by the rotation of the drill string 114, the rotary table 144 may impart torque and rotation to the drill string 114, which is then transmitted to the drill bit 118 by the drill string 114 and elements in the BHA 116.

In certain embodiments, the BHA 116 may further comprise a steering assembly, such as the RSS 124 comprising extendable pushers 124*a*. The pushers 124*a* may comprise pads, arms, fins, rods or any other element extendable from the RSS 124 to contact the borehole wall. The pushers 124*a* further may be circumferentially spaced around the RSS 124, and extendable without the use of fluid-driven pistons to contact the wall of and alter the angle of a longitudinal axis 126 of the RSS 124 with respect to an axis the borehole 110. The RSS 124 may be coupled to the drill bit 118 and may control the drilling direction of the drilling system 100 by controlling one or both of the angle of longitudinal axis 126 of the RSS 124 with respect to axis the borehole 110 and the angle of longitudinal axis 128 of the drill bit 118 with respect to the RSS 124. Altering one or both of those angles may offset a tool face 180 of the drill bit 118 such that it is non-parallel with the bottom of the borehole 110, thereby causing the drilling assembly to further drill the borehole with a directional offset relative to the immediately preceding portion of the borehole.

FIGS. 2A-C are diagrams of an example RSS 200 with pistonless pushers, according to aspects of the present disclosure. The RSS 200 comprises a tool collar 201 and a housing 202 positioned proximate to an end of the tool collar 201 and rotationally independent from the tool collar 201. The RSS 200 further comprises a radially offsetable drive shaft 203 that is at least partially within and passes through the housing 202 and that transfers torque from the tool collar 201 to a drill bit (not shown). As used herein, a drive shaft may be offsetable if at least a portion of it is configured to be offset from a longitudinal axis 204 of the RSS. In the embodiment shown, the offsetable drive shaft 203 may be directly or indirectly coupled to the tool collar 201 which may itself be coupled to a drill string or elements of a BHA. Rotation of the drill string may, in turn, cause the tool collar 201 and drive shaft 203 to rotate, and the rotation of the tool drive shaft 203 may drive a drill bit (not shown) coupled to the drive shaft 203 through bit sub 205. The housing 202 may remain stationary with respect to a borehole 260 while the tool collar 201 is rotating to drive the bit sub 205. In other embodiments, the housing 202 may rotate with the tool collar 201.

The offsetable drive shaft 203 may be supported within the housing 202 via supports, referred to in this context as focal points 206, which may comprise bearings/seals that allow the drive shaft 203 to rotate with respect to the focal points 206. The focal points 206 radially constrain a portion of the offsetable drive shaft 203 (typically, at a radially centered position as depicted here) within the housing 202, along the longitudinal axis 204 of the RSS 200. An offset mechanism 207, which is between the focal points 206 in the illustrated embodiment, is disposed about the offsetable drive shaft 203. The offset mechanism 207 may radially offset a portion of the drive shaft 203 between the focal points 206 with respect to the longitudinal axis 204 of the RSS 200. More particularly, as illustrated here, the drive shaft is flexible, and the radial offset involves flexing the drive shaft using the offset mechanism 207. As will be described below, the radial flexing or other controlled radial offset may cause a corresponding and opposite radial offset in a portion of the drive shaft 203 outside of the focal points 206, which may cause the longitudinal axis of a drill bit coupled to the bit sub 205 to be offset from the longitudinal axis 204 of the RSS 200.

In addition to altering the longitudinal axis of a drill bit with respect to the longitudinal axis 204 of the RSS 200, a radial offset in the drive shaft 203 may further cause the longitudinal axis 204 of the RSS 200 to be offset from the longitudinal axis of the borehole 260. In the embodiment shown, the RSS 200 comprises pushers 211 and 212 extendable from the housing 202 in response to a radial offset in the offsetable drive shaft 203 to contact a wall of the borehole 250 and offset the longitudinal axis 240 of the RSS 200. The pushers 211 and 212 may be coupled to a pusher assembly 209 carried on the offsetable drive shaft 203. As illustrated, the pusher assembly 209 is more particularly positioned around a portion of the offsetable drive shaft 203 between the focal points 206 and proximate the offset mechanism 207. Radial movement in the drive shaft 203 from the longitudinal axis 204 of the RSS 200 may cause radial movement of the pusher assembly 209, which in turn may cause one of the pushers 211 and 212 to extend radially outwards from the housing 202 and contact a wall of the borehole 260. Bearings 210 may be positioned within the pusher assembly 209 proximate the drive shaft 203 to allow the drive shaft to rotate freely with respect to the housing 203. The pushers 211 and 212 may comprise a hard metal bar or rod that is formed separately from and coupled to the pusher assembly 209, or may be integrally formed with the pusher assembly 209. The size and shape of the pushers 211 and 212 and pusher assembly 209 are not limited to the size and shape shown in FIGS. 2A-C.

When the drive shaft 203 is in a non-offset position, as it is in FIGS. 2A-C, the pushers 211 and 212 may protrude through holes in the housing 202, allowing the pushers 211 and 212 to be radially extended from the housing 202. Seal 208 may engage with the housing 202 and the pushers 211 and 212 to prevent formation fluids from entering the house. A sealing assembly 213 also may be positioned at the end of the housing 202 to prevent formation fluids from entering around the bit sub 205. Although the pushers 211 and 212 are shown extending from the housing 202 when in a non-offset position, the pushers 211 and 212 may be alternately configured to be flush with or receded with respect to the housing 202 when in a non-offset position.

In certain embodiments, the RSS 200 may comprise a control system that manages and controls the elements of the RSS 200 and thereby controls a drilling direction of the RSS 200. In the embodiment shown, the control system of the RSS 200 comprises a control unit 250. The control unit 250 may include processor, example of which include microprocessors, microcontrollers, digital signal processors (DSP), application specific integrated circuit (ASIC), or any other digital or analog circuitry configured to interpret and/or execute program instructions and/or process data. The control unit 250 may further comprise a memory element communicably coupled to the processor. The processor may be configured to interpret and/or execute program instructions and/or data stored in memory. Example memory elements comprise non-transitory computer readable media that may include any system, device, or apparatus configured to hold and/or house one or more memory modules; for example, memory may include read-only memory, random access memory, solid state memory, or disk-based memory. Each memory module may include any system, device or apparatus configured to retain program instructions and/or data for a period of time (e.g., computer-readable non-transitory media).

In the embodiment shown, the control unit 250 may be communicably coupled to the offset mechanism 207 and may output commands to the offset mechanism 207 to cause it to radially offset the drive shaft 203. The control unit 250 further may be coupled to one or more sensors 252 coupled to the housing 202, such as accelerometers and magnetometers, that can be used to determine the orientation of the housing 202. The control unit 250 may be communicably coupled to the offset mechanism 207 and sensors 252 across a rotating joint between the collar 201 and the housing 202. This coupling may be provided by an inductive coupling 254 or any other coupling that would be appreciated by one of ordinary skill in the art. In certain embodiments, the control unit 250 may further be coupled to a motor 256 that may control the rotational orientation of the housing 202 with respect to the collar 201, and may output control signals to the motor 256 to rotate the housing 202 with respect to the collar 201. In the embodiment shown, the offset mechanism 207 comprises a set of eccentric cam rings 280*a-c*. FIG. 2B is a cross section of the offset mechanism 207 along line A in FIG. 2A. Each ring of the cam rings 280*a-c* may comprise an inner opening eccentric with the ring's outer surface. The outermost cam ring 280*a*, for example, comprises a cylindrical outer surface that is concentric with and proximate to the inner surface of the housing 202, and an inner opening eccentric with the housing 202 and the outer surface of the ring 280*a*. In certain embodiments, the outermost cam ring 280*a* may be coupled to the housing 202, and in other embodiments a set of bearings may be positioned between the outer surface of the outermost cam ring 280*a* and the inner surface of the housing 202 to allow rotation between the two. Within the outermost cam ring 280*a* is an intermediate cam ring 280*b* with an inner opening eccentric with an outer surface of the intermediate cam ring 280*b* proximate the inner surface of the outermost cam ring 280*a*. Likewise, an innermost cam ring 280*c* may have an inner opening eccentric with an outer surface of the innermost cam ring 280*c* proximate the inner surface of the intermediate cam ring 280*b*. The drive shaft 203 may be positioned within the inner opening of the innermost cam ring 280*c*.

The portion of the drive shaft 203 within the cam rings 280*a-c* may be radially offset from the longitudinal axis 204 of the RSS by rotating one or more of the cam rings 280*a-c* with respect to the other of the cam rings 280*a-c*. For example, rotating the innermost cam ring 280*c* while maintaining the rotational orientation of the other rings 280*b* and 280*a* may cause the radial and rotational position of the eccentric inner opening to change, which in turn causes the position of the drive shaft 203 to change. In certain embodiments, the control system of the RSS 200 may generate control signals to an electric motor 256 within the housing 202 that can individually or collectively rotate one or more of the cam rings 28*a-c* to offset the drive shaft 203. Although eccentric cam rings 280*a-c* are shown, other offset mechanisms are possible within the scope of this disclosure. For example, electric actuators may be used to offset the drive shaft 203 and may respond to control signals directly from the control unit 250 to cause desired offsets.

FIG. 2C is a cross-section of the pushers 211 and 212 along line B in FIG. 2A. Because the pushers 211 and 212 are constrained by the holes in the housing 202 through which they extend, the pusher assembly 209 may restrain the movement of the drive shaft 203 to the radial directions indicated by the arrows 213. When the offset mechanism 207 attempts to offset the drive shaft 203 in a radial direction different than the one indicated by arrows 213, the control system of the RSS 200 may rotate the housing 202 to align the direction of radial movement of the pusher assembly 209 and pushers 211 and 212 with the direction of radial movement of the drive shaft 203. The RSS 200 therefore can accommodate radial offsets of the drive shaft 203 in any angular direction. Additionally, although the RSS 200 comprises two pushers 211 and 212 circumferentially positioned on opposite sides of the housing 202, different numbers and orientations of pushers may be used in different embodiments, including embodiments within only one pusher.

The drive shaft 203 in FIGS. 2A-C is in a non-offset position that corresponds to a "straight ahead" drilling direction in which a drill bit coupled to the bit sub 205 drills in a straight or near straight line with respect to the borehole 260. Radially offsetting the drive shaft 203 may cause the drill bit to drill at an offset angle from the borehole, with the magnitude of the offset angle depending on the amount of radial offset of the drive shaft 203. Notably, as will be described in detail below, the RSS 200 may provide for a greater offset angle than is provided in typical RSSs by offsetting the longitudinal axes of both the RSS 200 and the drill bit; in other words providing both point-the-bit and push-the-bit type functionality.

FIG. 3 is an example diagram illustrating the RSS 200 of FIGS. 2A-C in which the drive shaft 203 is radially offset. In the embodiment shown, the eccentric cam rings of the offset mechanism 207 have been rotated such that the portion of the drive shaft 203 within the offset mechanism has been offset radially from the longitudinal axis 204 of the RSS 200. This radial offset causes a bend in the drive shaft 203 between the focal points 206 that in turn causes radial movement of the pushers 211 and 212. In the embodiment shown, the pusher assembly 209 has been displaced radially upwards by the offset drive shaft 203 a distance D, which in turn has extended the pusher 211 a distance D from the housing 202 to contact a wall of the borehole 260. The contact between the pusher 211 and the wall of the borehole 260 may cause a push-the-bit type movement at the RSS 200 in which the longitudinal axis 204 of the RSS 200 is offset by an angle 264 from the longitudinal axis 262 of the borehole 260. The radial offset in the drive shaft 203 also may cause a point-the-bit type movement at the RSS 200. In particular, the radial offset in the drive shaft 203 between the focal points 206 may cause an opposite radial offset in a portion of the drive shaft 203 outside of the focal points 206, reflected, in this embodiment, by the longitudinal axis 268 of the bit sub 205 being offset by an angle 266 from the longitudinal axis 204 of the RSS 200.

As can be seen, the offset angles 264 and 266 are radially aligned such that they form a total offset angle 270 between the longitudinal axis 268 of the bit sub 205 and the longitudinal axis 262 of the borehole 260. The total offset angle 270 may reflect the angle in which a drill bit coupled to the RSS 200 drills with respect to the existing borehole 260. Notably, the RSS 200 may provide for a greater offset angle than a typical RSS because it generates both a push-the-bit type offset angle 264 and a point-the-bit type offset angle 266 that are radially aligned with respect to the borehole 260, rather than an offset angle of only one type.

During drilling operations, the housing 202 may remain stationary with respect to the borehole 260 to maintain the angular orientation of the bit sub 205 and attached drill bit. In certain embodiments, the housing 202 may remain stationary based, at least in part, on the contact between the wall of the borehole 260 and the pushers 211 and 212. In other embodiments, the housing 202 may remain stationary with respect to the borehole 260 through a counter rotation controlled by the control unit 250. In particular, the control unit 250 may determine the rotational speed and direction of the tool collar 201, and may output signals to the motor 256 to rotate the housing 202 in the same speed but opposite direction as the tool collar 201, such that the housing 202 remains stationary with respect to the borehole 260.

FIGS. 4A-B are diagrams illustrating another example RSS 400 with pistonless pushers, according to aspects of the present disclosure. The RSS 400 may have certain elements in common with or similar to those in to the RSS described above, including a tool collar (not shown), a housing 402 positioned proximate an end of and rotationally independent from the tool collar, and an offsetable drive shaft 403 coupled to the tool collar and at least partially within the housing. The RSS 400 differs, in one respect, in that the pushers 411-414 are carried by the housing 402 rather than the drive shaft 403, allowing 360 degrees of angular deflection at the drive shaft 403 without rotationally orienting the pushers to align with the direction of the radial offset at the drive shaft 403. In the embodiment shown, each of the pushers 411-414 are positioned within circumferentially-spaced holes in the housing 402 that allow the pushers 411-414 to be extended from the housing 402 in one of four directions. Although four pushers are shown, other orientations and numbers are possible.

Unlike the RSS described above in which the pushers are carried by the drive shaft via a pusher assembly around the drive shaft, the pushers 411-414 are carried by the housing 402 and can move independently from the drive shaft 403 and the other pushers 411-414. The pushers 411-414 are constrained by the housing to move radially in and out of the housing through their respective openings in the housing 402. In the embodiment shown, each of the pushers 411-414 optionally comprise corresponding springs 411*a*-414*a* that bias the pushers 411-414 towards the drive shaft 403. When the drive shaft 403 is radially offset in a particular direction, it may apply a force to one or more of the pushers sufficient to overcome the biasing force applied by the corresponding spring, thereby causing the pusher(s) to extend from the housing 402. When the drive shaft 403 is returned to a non-offset position, the biasing force applied by the spring may cause the corresponding pusher to retract.

In the embodiment shown, each of the pushers 411-414 comprise corresponding ends proximate the drive shaft 403 that are larger that the portions of the pushers extending through the housing 402. The enlarged ends increase the contact area between the pushers 411-414 and drive shaft 403 to more completely translate radial offsets at the drive shaft 403 to radial movements by the pushers 411-414. For example, a radial offset of the drive shaft 403 in an angular orientation 404 between the angular orientations of the pushers 411 and 413 may still cause both the pushers 411 and 413 to be extended from the housing 402 due to the enlarged ends of the pushers 411 and 413. Additionally, the enlarged ends may secure the pushers 411-414 within the housing and prevent the drive shaft 403 from becoming wedged between two adjacent pushers.

According to aspects of the present disclosure, an example apparatus for controlling the direction of drilling a borehole includes a housing and a radially offsetable drive shaft at least partially within the housing. The apparatus may further include one or more pusher extendable from the housing. The one or more pusher may be extendable in response to a radial offset in the offsetable drive shaft with respect to a longitudinal axis of the housing.

In certain embodiments, the one or more pusher comprises at least one of a rod, pad, arm, or fin extendable through an opening in the housing. In certain embodiments, the one or more pusher is coupled to a pusher assembly carried on the offsetable drive shaft. In certain embodiments, the one or more pusher is carried on the housing, and a particular pusher is engaged by the offsetable drive in response to a radial offset of the drive shaft toward the particular pusher. In certain embodiments, the one or more pusher comprises an end proximate the offsetable drive shaft that is larger than a portion of the pusher extending through the housing. In certain embodiments, the one or more pusher further comprises a spring biasing the pusher towards the offsetable drive shaft. In certain embodiments, the one or more pusher comprises one of a plurality of pushers circumferentially arranged around the housing.

In any one of the embodiments described in the preceding two paragraphs, the apparatus may further comprise tool collar, wherein the housing is positioned proximate an end of the tool collar and rotationally independent from the tool collar; and the offsetable drive shaft is coupled to the tool collar. In any one of the embodiments described in the preceding two paragraphs, the offsetable drive shaft may comprise a flexible drive shaft secured within the housing at focal points; and each pusher is located between the focal points. In certain embodiments, the apparatus may further comprise an offset mechanism between the focal points within the housing to radially offset the offsetable drive shaft with respect to the longitudinal axis of the housing. In certain embodiments, the offset mechanism comprises a set of eccentric cam rings around the offsetable drive shaft.

According to aspects of the present disclosure, an example for controlling the direction of drilling a borehole comprises positioning a steering assembly within a borehole. A longitudinal axis of a drill bit coupled to the steering assembly may be offset from a longitudinal axis of a housing of the steering assembly. The method may further include offsetting the longitudinal axis of the housing from a longitudinal axis of the borehole.

In certain embodiments, offsetting the longitudinal axis of the drill bit coupled to the steering assembly from the longitudinal axis of the housing of the steering assembly and offsetting the longitudinal axis of the housing from the longitudinal axis of the borehole comprise radially offsetting a radially offsetable drive shaft at least partially within the housing with respect to the longitudinal axis of the housing. In certain embodiments, offsetting the longitudinal axis of the housing from the longitudinal axis of the borehole further comprises extending a pusher from the housing by radially offsetting the offsetable drive shaft at least partially within the housing with respect to the longitudinal axis of the housing. In certain embodiments, extending the pusher from the housing by radially offsetting the offsetable drive shaft at least partially within the housing with respect to the longitudinal axis of the housing comprises radially offsetting a pusher assembly positioned around a portion of the offsetable drive shaft and to which the pusher is coupled. In certain embodiments, extending the pusher from the housing by radially offsetting the offsetable drive shaft at least partially within the housing with respect to the longitudinal axis of the housing comprises radially offsetting the offsetable drive shaft to overcome a force biasing the pusher toward the offsetable drive shaft.

In any one of the embodiments of the preceding two paragraphs, offsetting the longitudinal axis of the housing from a longitudinal axis of the borehole may comprise rotating the housing with respect to a tool collar of the steering assembly. In any one of the embodiments of the preceding two paragraphs, radially offsetting an offsetable drive shaft at least partially within the housing with respect to the longitudinal axis of the housing may comprise bending a flexible drive shaft about focal points positioned within the housing. In certain embodiments, bending a flexible drive shaft about focal points positioned within the housing comprises rotating one or more eccentric cam rings positioned around a portion of the offsetable drive shaft. In certain embodiments, rotating one or more eccentric cam rings positioned around a portion of the offsetable drive shaft comprises rotating one or more eccentric cam rings with a motor coupled to the housing. In certain embodiments, rotating one or more eccentric cam rings with the motor coupled to the housing comprises generating one or more control signals at a control unit of the steering assembly.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces. Additionally, the terms "couple" or "coupled" or any common variation as used in the detailed description or claims are not intended to be limited to a direct coupling. Rather two elements may be coupled indirectly and still be considered coupled within the scope of the detailed description and claims.

What is claimed is:

1. An apparatus for use in a borehole to control the direction of drilling the borehole, comprising:

a housing;

a radially offsetable drive shaft at least partially within the housing and coupled to the drill bit to drive rotation of the drill bit; and one or more pushers extendable from the housing in response to the radial offset in the offsetable drive shaft with respect to a longitudinal axis of the housing to contact a wall of the borehole.

2. The apparatus of claim 1, wherein the one or more pushers comprises at least one of a rod, pad, arm, or fin extendable through an opening in the housing.

3. The apparatus of claim 1, wherein the one or more pushers is coupled to a pusher assembly carried on the offsetable drive shaft.

4. The apparatus of claim 1, wherein the one or more pushers are carried on the housing, and a first pusher of the one or more pushers is engaged by the offsetable drive in response to a radial offset of the drive shaft toward the first pusher.

5. The apparatus of claim 4, wherein the one or more pushers comprises an end proximate the offsetable drive shaft that is larger than a portion of the one or more pushers that extends through the housing.

6. The apparatus of claim 5, wherein the one or more pushers comprise one of a plurality of pushers circumferentially arranged around the housing.

7. The apparatus of claim 4, wherein the one or more pushers further comprises a spring biasing the one or more pushers towards the offsetable drive shaft.

8. The apparatus of claim 1, further comprises a tool collar, wherein the housing is positioned proximate an end of the tool collar and rotationally independent from the tool collar; and the offsetable drive shaft is coupled to the tool collar.

9. The apparatus of claim 1, wherein the offsetable drive shaft comprises a flexible drive shaft secured within the housing at focal points; and each pusher is located between the focal points.

10. The apparatus of claim 9, further comprising an offset mechanism between the focal points within the housing to radially offset the offsetable drive shaft with respect to the longitudinal axis of the housing.

11. The apparatus of claim 10, wherein the offset mechanism comprises a set of eccentric cam rings around the offsetable drive shaft.

* * * * *